US010571175B2

(12) United States Patent
Burg et al.

(10) Patent No.: US 10,571,175 B2
(45) Date of Patent: Feb. 25, 2020

(54) HEAT PUMP TEMPERATURE CONTROL

(71) Applicant: Desert Aire Corp., Germantown, WI (US)

(72) Inventors: Craig Michael Burg, Sussex, WI (US); Jeremy Hogan, Greenfield, WI (US); Harold Mark Sindelar, Beaver Dam, WI (US)

(73) Assignee: Desert Aire Corp., Germantown, WI (US)

( * ) Notice: Subject to any disclaimer, the term of this patent is extended or adjusted under 35 U.S.C. 154(b) by 341 days.

(21) Appl. No.: 14/602,765

(22) Filed: Jan. 22, 2015

(65) Prior Publication Data

US 2015/0204591 A1 Jul. 23, 2015

Related U.S. Application Data

(60) Provisional application No. 61/930,205, filed on Jan. 22, 2014.

(51) Int. Cl.
*F25B 49/02* (2006.01)

(52) U.S. Cl.
CPC ..... *F25B 49/02* (2013.01)

(58) Field of Classification Search
CPC ..... F25B 30/02; F25B 41/04; F25B 41/046; F25B 6/04; F25B 49/02; F25B 13/00; F25B 2400/0409; F25B 2400/0403; F25B 2400/0411; F25B 2400/0413; F25B 2400/0415; F25B 2313/021; F25B 2339/047; F25B 2600/2501; F25B 2600/2507; F25B 2600/022; F25B 2600/025; F25B 2600/0253; F25B 2600/0261; F25B 1/10; F25B 40/00
USPC ..... 62/324.6, 159, 196.4, 197, 226, 228.1, 62/238.6, 506
See application file for complete search history.

(56) References Cited

U.S. PATENT DOCUMENTS 6,347,528 B1 * 2/2002 Iritani ..... B60H 1/00357 62/323.1
2003/0188544 A1 * 10/2003 Yamasaki ..... F25B 1/10 62/238.1
2010/0300135 A1 * 12/2010 Otake ..... F24D 17/02 62/335
2011/0100035 A1 * 5/2011 Taras ..... F24F 3/153 62/90
2011/0167850 A1 * 7/2011 Itoh ..... F25B 5/04 62/160
2012/0272673 A1 * 11/2012 Yokohara ..... F25B 41/04 62/180

* cited by examiner

*Primary Examiner* — Joseph F Trpisovsky
(74) *Attorney, Agent, or Firm* — Boyle Fredrickson S.C.

(57) ABSTRACT

A heat pump system that can be selectively utilized to discharge excessive heating and cooling capacity toward secondary devices of the system to maintain operation of the heat pump system to better manage the respective temperatures associated with the fluid flows in a manner that reduces the need for cycling the heat pump system ON and OFF to attain desired fluid output temperature manipulations.

15 Claims, 3 Drawing Sheets

HEAT PUMP TEMPERATURE CONTROL

CROSS-REFERENCE TO RELATED APPLICATIONS

This application claims priority to U.S. Provisional Patent Application Ser. No. 61/930,205 titled "HEAT PUMP TEMPERATURE CONTROL" filed on Jan. 22, 2014 and the entire contents of which is expressly incorporated herein.

BACKGROUND OF THE INVENTION

The present invention relates generally to heat pump systems and more particularly to a heating and cooling system constructed to generate a desired output flow temperature in a manner that maintains operation of the underlying heat pump system so as to mitigate cycling of the system between ON and OFF operating states.

Many standard heat pumps utilize fixed speed compressors and multiple condensers to discharge only a required or desired amount of heat into an air flow. Using multiple condensers results in configurations wherein one or more condensers are not in the airstream associated with the fluid flow whose temperature is being manipulated such that such condensers discharge excess heat to a thermal dump. The thermal discharge associated with such condensers is considered wasted energy in as much as the energy associated with the thermal dump is never recaptured by the system and thereby detracts from the overall efficiency associated with operation of the underlying heat pump system. Although using only one condenser decreases the amount of waste heat generated, such systems require that the compressor be repeatedly cycled between ON and OFF operating states to prevent overheating of a respective air stream and thereby the space whose environmental temperature is to be manipulated. Cycling the compressor between and ON and OFF operating conditions results in inefficient utilization of the compressor and can increase wear associated with operation of the compressor which promotes premature failure of the compressor. Accordingly, there is a need for a heat pump system that can more efficiently transfer or communicate system energy to an intended environment and in a manner that mitigates undesired overshoot associated with call for heat instructions.

BRIEF DESCRIPTION OF THE INVENTION

The present invention is directed to a heat pump system and method of controlling heat pump systems that solves one of more of the shortcomings disclosed above. The heat pump system according to one aspect of the present invention provides heating and cooling functionality in a manner that mitigates overshoot associated with manipulation of the fluid whose temperature is to be controlled. The system can utilize the functionality of a second heater during both heating, and cooling operations to improve the control and efficiency associated with operation of the heat pump system.

Another aspect of the invention discloses a heat pump system having a variable stage compressor that is fluidly connected to a fluid flow. An evaporator is connected to the fluid flow and disposed upstream relative to the direction of the fluid flow toward the variable stage compressor. A condenser is connected to the fluid flow and associated with an air stream and disposed downstream of the variable stage compressor. A valve assembly is disposed in the fluid flow associated with a bypass passage between an upstream side of the evaporator and an upstream side of the condenser. The valve assembly is operable to allow a portion of the fluid flow directed from the variable stage compressor toward the condenser to be directed upstream of the evaporator to reduce a thermal exchange between the fluid flow and the air stream directed through the condenser.

Another aspect of the invention discloses a method of forming a heat pump system that includes manipulating a pressure of a fluid with a variable stage compressor. Operation of the variable stage compressor is controlled in response to a temperature demand from a heat exchanger and a fluid conducting condition of a bypass passage that allows a portion of the fluid output from the variable stage compressor to bypass the heat exchanger and to be directed upstream of the variable stage compressor.

Another aspect of the invention discloses a heat pump system that includes a variable stage compressor, a first heat exchanger and a second heat exchanger. The first heat exchanger is fluidly disposed upstream of the variable stage compressor and the second heat exchanger is disposed downstream of the variable stage compressor such that an air flow can be disposed in thermal communication with at least one of the first heat exchanger and the second heat exchanger. A bypass passage extends between upstream sides of the first heat exchanger and the second heat exchanger and a valve arrangement is associated with a bypass passage. The valve arrangement is operable to direct a fluid flow directed from the variable stage compressor toward the second heat exchanger to be directed upstream of the first heat exchanger to reduce a thermal exchange between the fluid flow and the air flow directed through the second heat exchanger.

These and other aspects, advantages, and features of the present invention will be better understood and appreciated from the drawings and the following description.

BRIEF DESCRIPTION OF THE DRAWING(S)

The drawings are for illustrative purposes only and the invention is not to be limited to the exemplary embodiment shown therein. In the drawings.

Figure 1:
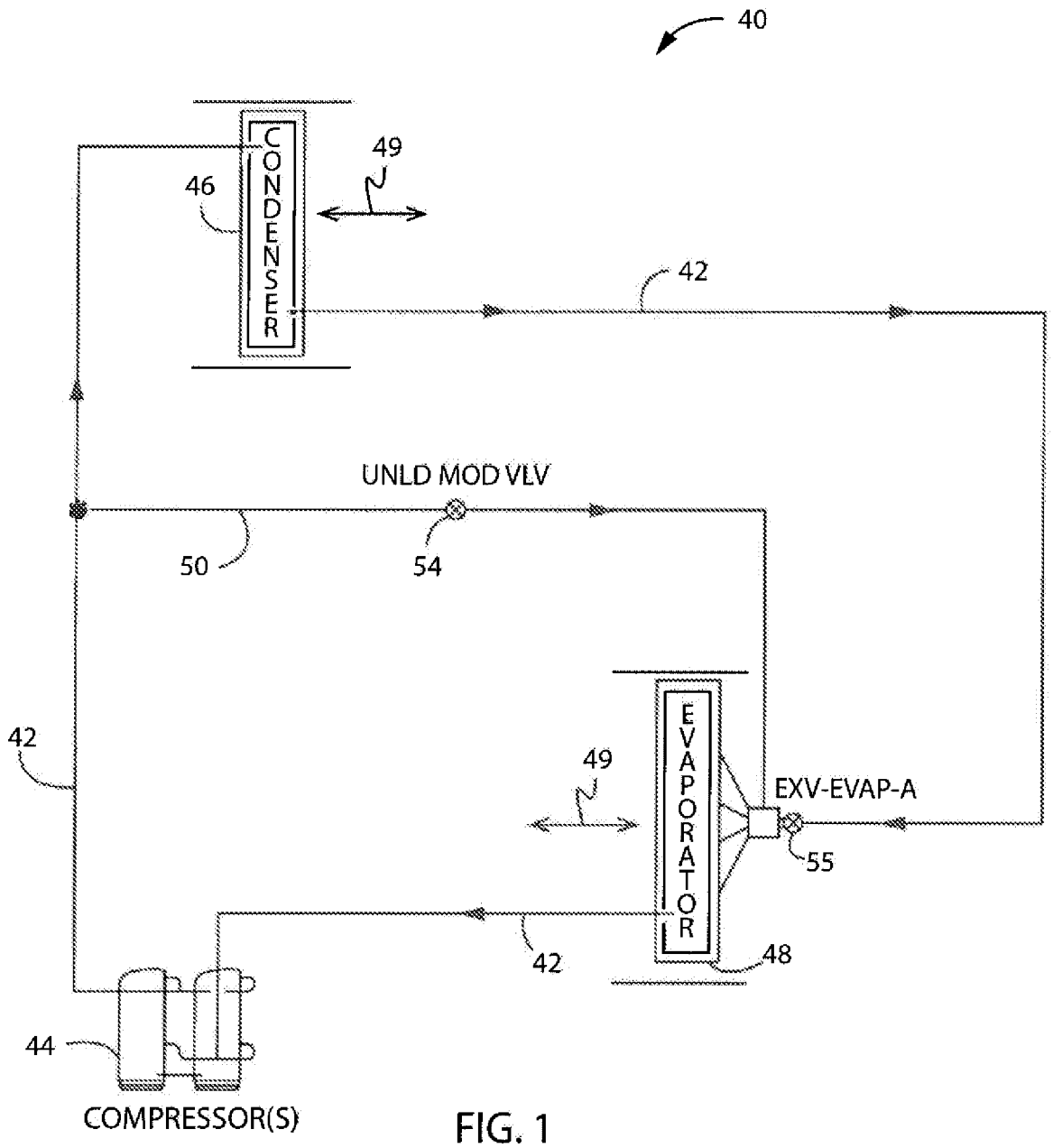
FIG. 1 shows a heat pump system according to one embodiment of the invention.

In describing the preferred embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized, as being equivalent by those skilled in the art.

DETAILED DESCRIPTION OF THE PREFERRED EMBODIMENTS

FIG. 1 shows a heat pump system 40 according to one embodiment of the present invention. System 40 includes a working fluid path or fluid path 42 associated with a compressor 44, a first heat exchanger such as a condenser 46, and the second heat exchanger such as an evaporator 48. One or both of condenser 46 and evaporator 48 can fluidly communicate with an airflow 49 associated with an environment whose temperature is intended to be manipulated. Evaporator 48 is located upstream of compressor 44 whereas condenser 46 is oriented generally downstream from compressor 44 and upstream relative to evaporator 48 with respect to the direction of the fluid flow associated with fluid path 42.

System 40 includes a bypass passage 50 that fluidly connects a portion of fluid path 42 that is downstream of compressor 44 but upstream of condenser 46 to a portion of fluid path 42 that is upstream of evaporator 48 and compressor 44. Bypass passage 50 includes an unloading modulating valve assembly or simply valve assembly 54. Valve assembly 54 is operable to allow a portion of the fluid output from compressor 44 directed toward condenser 46 to bypass condenser 46 and be reintroduced to fluid stream 42 at a location upstream of evaporator 48 and/or compressor 44. Another valve assembly 55 can be disposed in fluid path 42 between condenser 46 and evaporator 48. The operation of one or more of valve assemblies 54, 55 is described further below with respect FIG. 3 with respect to manipulating the capacity of the heat pump system to exchange thermal energy with the air system to which it is associated and in a manner that improves the efficiency associated with operation and utilization of system 40.

Figure 2:
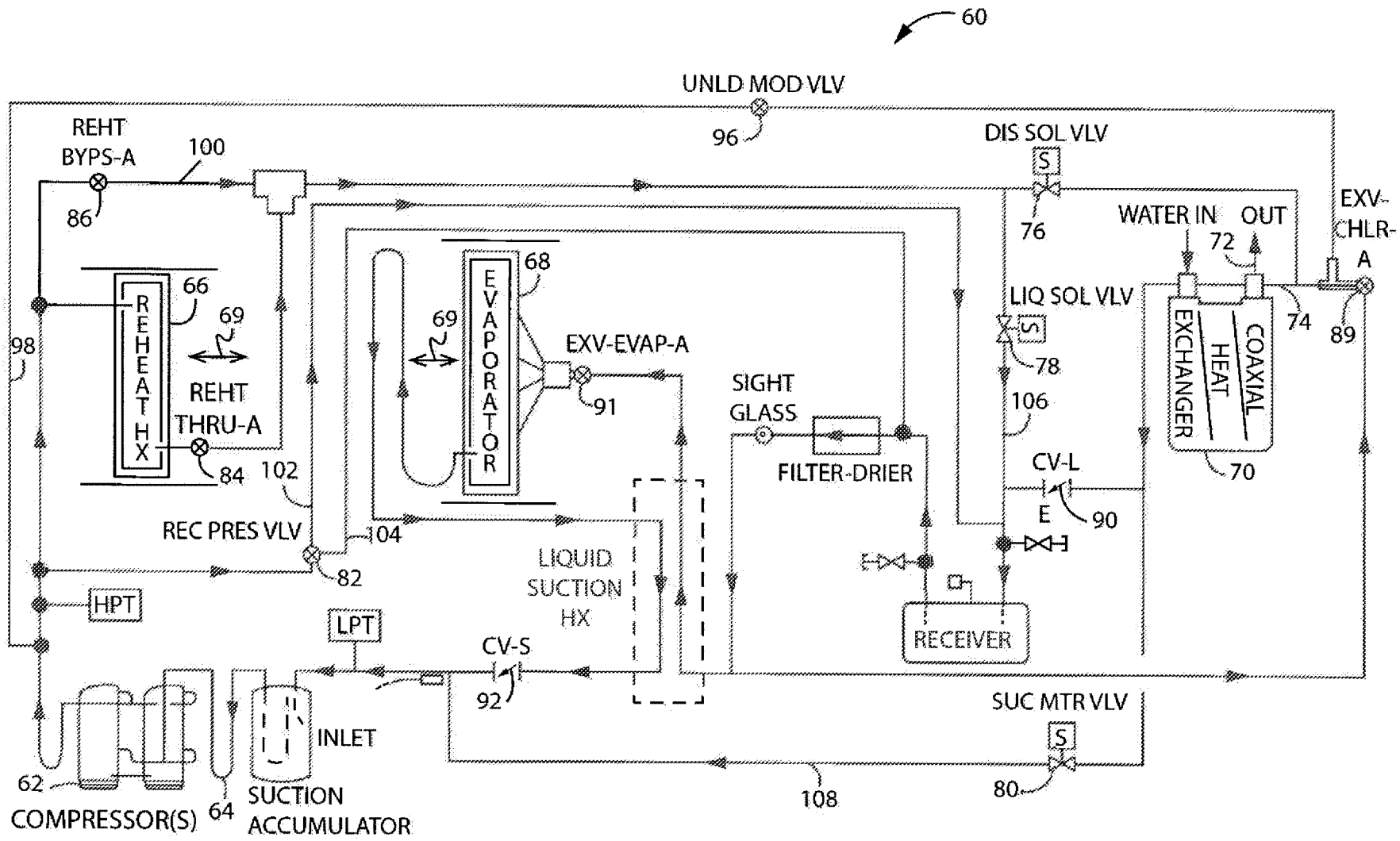
FIG. 2 shows a heat pump system according to another embodiment of the invention.

FIG. 2 shows a heat pump assembly or system. 60 according to another embodiment of the invention. System 60 includes a compressor 62 that is disposed in a fluid path 64 generally between a heat exchanger such as a condenser 66 and another heat exchanger such as an evaporator 68. Compressor 62 is preferably a multi-stage compressor. Like system 40, heat exchanger 66 and evaporator 68 can each or both be disposed to an airstream 69 whose temperature is intended to be manipulated via operation of heat pump system 60.

Due to the thermal demands associated with operation and utilization of system 60, system 60 can include a fluid, such as water, that is communicated to a refrigerant heat exchanger 70 that includes a first fluid path 72 and the second fluid path 74 that are isolated from one another but in thermal interaction with one another. It should be appreciated that second fluid path 74 of heat exchanger 70 forms a respective portion of fluid path 64, and the fluid associated therewith. System 60 can include one or more valves 76, 78, 80, 82, 84, 86, 89, 91 and one or more directional flow devices, such as backflow preventers 90, 92, associated with achieving a desired flow associated with flow path 64 through system 60 to achieve the desired thermal exchange associated with the airflow 69 whose temperature is being manipulated via interaction with one or both of heat exchanger 66, evaporator 68, and/or heat exchanger 70.

System 60 includes an unloading modulation valve 96 that is fluidly associated with a bypass passage 98. Bypass passage 98 is fluidly connected downstream of compressor 62 and upstream relative to heat exchanger 66. System 60 can include one or more pressure signal passages or connections and/or supplemental bypass passages 100, 102, 104, 106, 108 that are operable to communicate fluid condition signals or allow respective portions of the fluid flow associated with fluid path 64 to bypass one or more of heat exchanger 66, evaporator 68, and/or heat exchanger 70, to achieve the desired operational and thermal exchange associated with the communication of the treated air flow 69 through heat exchanger 66 and/or evaporator 68. For example, connection 104 communicates a pressure signal to valve 82 but does not accommodate a flow of fluid whereas bypass passage 108 accommodates a flow of fluid toward compressor 62 along a passage that bypasses evaporator 68. It is further appreciated that although unloading modulation valve 96 is shown as being disposed in bypass passage 98, other configurations are envisioned to achieve the objectives described below with respect to FIG. 3 and the corresponding operation of systems 40 and/or 60.

Figure 3:
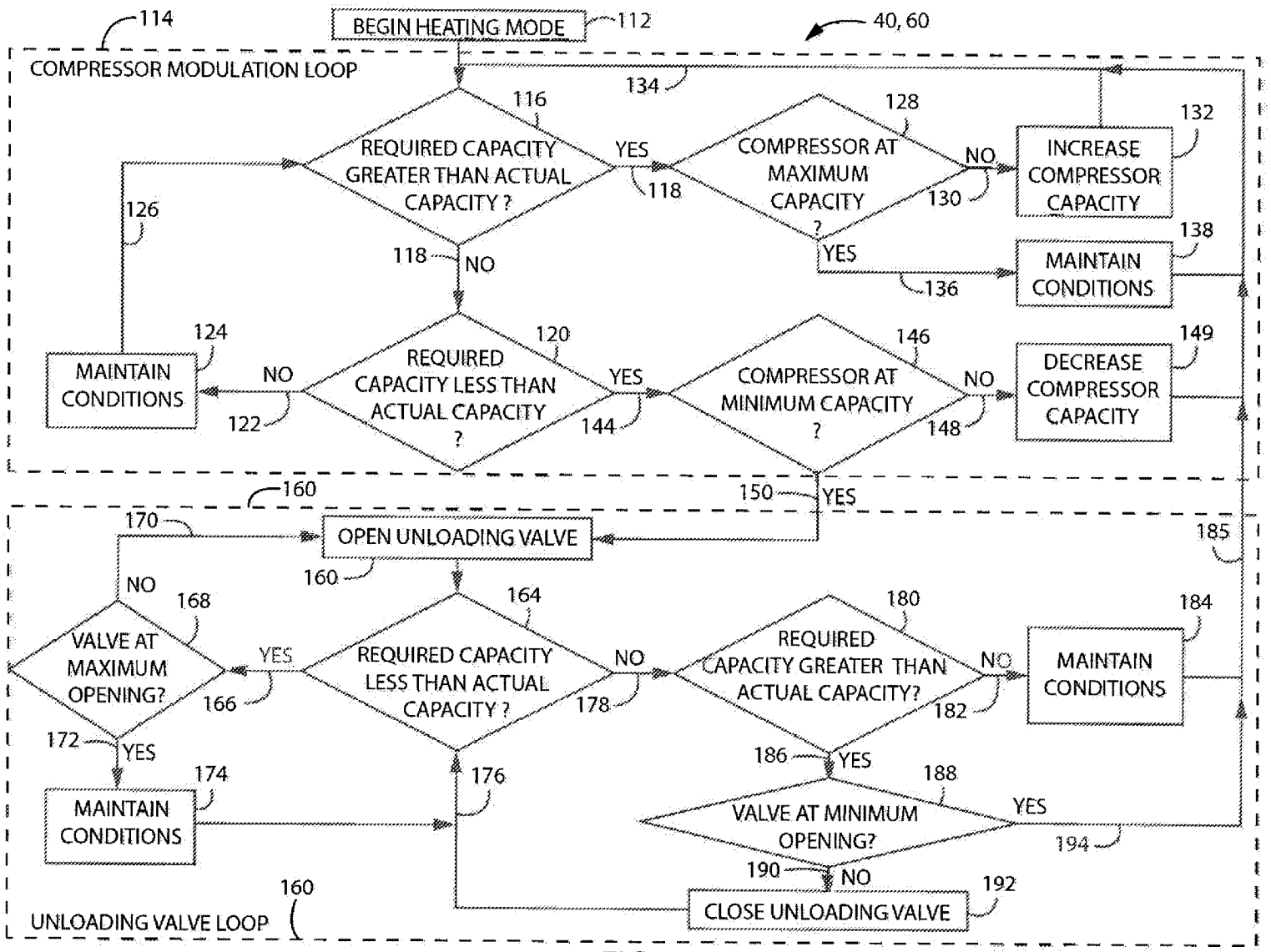
FIG. 3 shows an operational control sequence associated with the heat pump systems shown in FIGS. 1 and 2.

FIG. 3 is a graphical representation associated with the operation of systems 40 and/or 60. It is appreciated that the operational logic shown in FIG. 3 can be disposed on various types of electronic devices or one or more controllers associated with providing the variable control associated with operation of a respective system 40, 60 to achieve the desired operation thereof. Referring to FIG. 3, during a heating mode of operation 112 of systems 40, 60, a determination is made with respect to the component compressor modulation loop 114 as to whether the required capacity is greater than an actual capacity 116 associated with a current operating condition of compressor 44, 62. If the required capacity is not greater than the actual capacity 118, compressor modulation loop 114 assesses whether a required capacity or demand is less than an actual capacity 120 and, if not 122, current operating conditions 124 are maintained and modulation loop 114 returns 126 to the capacity assessment 116.

If a required capacity or demand is greater than an actual current capacity 118, compressor modulation loop 114 assesses whether compressor 44, 62 is operating at maximum capacity 128 associated with a respective stage of operation and, if not 130, increases the compressor capacity 132 prior to reassessing the capacity 134, 116. If the required capacity is greater than the actual capacity 118, and the compressor is currently at maximum capacity 136, system 40, 60 maintains current operating conditions 138 associated with compressor modulation loop 114 prior to returning to assess required versus actual capacity 116. If the required capacity is not greater than the actual capacity 118, and the required capacity is less than an actual capacity 144, compressor modulation loop 114 determines if the compressor 44, 62 is at a minimum capacity 146 and, if not 148, decreases the compressor capacity 149, and system 40, 60 returns to the assessment of capacity being greater than actual capacity 116.

If compressor modulation loop 114 determines that the compressor is at a relative minimum capacity 150 associated with any given stage of operation associated with the compressor relative to the demand placed upon system 40, 60, the control of systems 40, 60 proceed to an unloading valve operation loop 160 associated with manipulating the operation of the respective unloading valve 54, 96. The respective unloading valve incrementally opens 162 such that unloading valve loop 160 can assess whether required capacity is less than an actual capacity 164. If the required capacity is less than the actual capacity 166, unloading valve loop 160 assesses an open condition of the valve 168 and, if the valve is not at a maximum open position 170, loop 160 returns to increment opening of the unloading valve 162.

If the respective unloading valve is in fact all the way open 172, indicating a full bypass condition, the operating conditions associated with modulation loop 114 and control valve loop 160 are maintained 174 and loop 160 returns to the assessment of the required capacity versus actual capacity 164 associated with operation of the respective system. If the required capacity is not less than the actual capacity 178, loop 160 determines whether the required capacity is greater than the actual capacity 180 and, if not 182, maintains the instantaneous operating conditions 184 prior to returning 185 to the assessments associated with compressor modulation loop 114. If the required capacity is greater than the actual capacity 186, unloading valve loop 160 assesses whether the unloading modulation valve 54, 96 is at a minimum open condition 188 and if not 190, increments closing of the valve 192 prior to returning to the assessment of capacity 176. If the required capacity is greater than the actual capacity 186, and the unloading modulation valve is at a minimum open condition 190, unloading valve loop 160 returns 194 to compressor modulation loop 114 to repeat the assessment associated with the operation of compressor modulation loop 114.

The operation of systems 40, 60 provides a precision temperature control heat pump that utilizes a variable capacity compressor to limit the amount of heat that needs to be rejected at any given stage of operation of the respective system and/or compressor. When the compressor is at its minimum capacity, the operation of the unloading valve assemblies allows a portion of the output of the respective compressor to bypass the respective condenser and toward the respective evaporator which further decreases the thermal transfer capacity associated with the system and, in turn, results in very accurate temperature control associated with operation of the heat pump and with only negligible wasted heat. Such a construction allows operation of the respective system compressor at minimum capacities associated with satisfying respective system demands at each stage of operation of the respective compressor.

During operation of systems 40, 60, if the air-side condenser is overheating the treated air flow, such that the capacity produced is greater than the capacity required, the respective unloading modulation valve opens slightly to bypass the respective condenser and send hot gas to the evaporator associated with the system. The hot gas passing through the respective bypass valve assembly decreases the amount of gas directed into the air-side condenser which reduces the thermal exchange capacity. The gas also increases suction temperature associated with the upstream compressor flow thereby decreasing evaporator and system thermal exchange capacity in a manner that controls operation of the system to maintain the system parameters at conditions that accommodate target temperature conditions with smaller deviations relative thereto. The bypass modulating valve assemblies associated with the respective systems modulate to achieve desired supply air temperature conditions until the mode of operation changes from cooling, the thermal exchange capacity increases such that the unloading valve assembly completely closes and the compressor may increase capacity, and/or the maximum allowable valve open condition is reached thereby indicating a change to the compressor stage is required if available. Preferably, in order to maintain some cooling capacity associated with operation of systems 40, 60, the control associated with the operation of the respective bypass unloading valve assembly includes an upper threshold associated with allowing the precise temperature control described above in a manner that does not jeopardize the longevity associated with operation of systems 40, 60 or the discrete components or devices associated therewith.

Therefore, one embodiment of the invention includes a heat pump system having a variable stage compressor that is fluidly connected to a fluid flow. An evaporator is connected to the fluid flow and disposed upstream relative to the direction of the fluid flow toward the variable stage compressor. A condenser is connected to the fluid flow and associated with an air stream and disposed downstream of the variable stage compressor. A valve assembly is disposed in the fluid flow associated with a bypass passage between an upstream side of the evaporator and an upstream side of the condenser. The valve assembly is operable to allow a portion of the fluid flow directed from the variable stage compressor toward the condenser to be directed upstream of the evaporator to reduce a thermal exchange between the fluid flow and the air stream directed through the condenser.

Another embodiment of the invention includes a method of forming a heat pump system that includes manipulating a pressure of a fluid with a variable stage compressor. Operation of the variable stage compressor is controlled in response to a temperature demand from a heat exchanger and a fluid conducting condition of a bypass passage that allows a portion of the fluid output from the variable stage compressor to bypass the heat exchanger and to be directed upstream of the variable stage compressor.

Another embodiment of the invention includes a heat pump system having a variable stage compressor, a first heat exchanger, and a second heat exchanger. The first heat exchanger is fluidly disposed upstream of the variable stage compressor and the second heat exchanger is disposed downstream of the variable stage compressor such that an air flow can be disposed in thermal communication with at least one of the first heat exchanger and the second heat exchanger. A bypass passage extends between upstream sides of the first heat exchanger and the second heat exchanger and a valve arrangement is associated with a bypass passage. The valve arrangement is operable to direct a fluid flow directed from the variable stage compressor toward the second heat exchanger to be directed upstream of the first heat exchanger to reduce a thermal exchange between the fluid flow and the air flow directed through the second heat exchanger.

The present invention has been described in terms of the preferred embodiments, and it is recognized that equivalents, alternatives, and modifications, aside from those expressly stated, are possible and within the scope of the appending claims. It is further appreciated that although various embodiments of the proposed systems are disclosed herein, that various features and/or aspects of the various embodiments are combinable and/or usable together.

What is claimed is:

1. A heat pump system comprising:

a variable stage compressor fluidly connected to a fluid flow;

an evaporator connected to the fluid flow and disposed upstream relative to the direction of the fluid flow toward the variable stage compressor;

a condenser connected to the fluid flow and associated with an air stream, the condenser being disposed downstream of the variable stage compressor;

a heat exchanger connected to the fluid flow, the heat exchanger being disposed downstream of the variable stage compressor;

a valve assembly disposed in the fluid flow associated with a bypass passage between an upstream side of the evaporator and upstream sides of the condenser and the heat exchanger, the valve assembly being operable, during each of a plurality of stages of operation of the variable stage compressor, to allow a portion of the fluid flow directed from the variable stage compressor toward the condenser to be directed through the bypass passage from a location immediately upstream of the condenser to a location downstream of the condenser and upstream of the evaporator to bypass all heat exchangers between the variable stage compressor and the evaporator, including bypass of the condenser and the heat exchanger, to reduce a thermal exchange between the fluid flow and the air stream directed through the condenser; and a controller configured to control the variable stage compressor to operate at a lowest possible stage of the plurality of stages of the variable stage compressor associated with satisfying a given demand associated with the air stream, wherein, when a demand is less than a capacity of the heat pump system to exchange thermal energy with the air stream and the variable stage compressor is at a minimum capacity, the controller controls the valve arrangement to incrementally open and close the bypass passage to satisfy the demand, until a minimum opening or a maximum opening of the valve arrangement is reached, and wherein, when the demand is greater than the capacity of the heat pump system to exchange thermal energy with the air stream and the valve arrangement is at the minimum opening, the controller controls the valve arrangement to maintain the bypass passage and controls the variable stage compressor to increase a capacity of the variable stage compressor to satisfy the demand, until a maximum capacity of the variable stage compressor is reached.

2. The heat pump system of claim 1 wherein a flow associated with the bypass passage and a fully open valve assembly is less than a flow generated by the variable stage compressor.

3. The heat pump system of claim 1 wherein the controller is further configured to control operation of the valve assembly during operation of the variable stage compressor.

4. The heat pump system of claim 3 wherein the controller increases an operating condition of the variable stage compressor when the valve assembly is fully closed and a demand for heat exists.

5. The heat pump system of claim 4 wherein the controller is configured to manipulate an orientation of the valve assembly for each stage of operation of the variable stage compressor.

6. The heat pump system of claim 1 wherein the heat exchanger has a first fluid side associated with the fluid flow and a second fluid side associated with a thermal sink flow.

7. The heat pump system of claim 6 further comprising another bypass passage between an outlet side of the heat exchanger and an inlet side of the variable stage compressor.

8. The heat pump system of claim 7 further comprising a further bypass passage between the upstream side of the condenser and an upstream side of the heat exchanger.

9. The heat pump system of claim 3 wherein the controller is configured to incrementally open the valve assembly to assess whether the given demand is satisfied between each increment when an operating condition exceeds a demand for heat.

10. The heat pump system of claim 3 wherein the controller is configured to incrementally close the valve assembly to assess whether the given demand is satisfied between each increment when a demand for heat exceeds an operating condition.

11. A heat pump system comprising:

a variable stage compressor having a plurality of stages of operation;

a first heat exchanger fluidly disposed upstream of the variable stage compressor;

a second heat exchanger that is downstream of the variable stage compressor, a first air flow being in thermal communication with the first heat exchanger and a second air flow for extracting energy being in thermal communication with the second heat exchanger;

a third heat exchanger that is downstream of the variable stage compressor;

a bypass passage that extends between an upstream side of the first heat exchanger and upstream sides of the second and third heat exchangers;

a valve arrangement associated with the bypass passage and being operable to direct a fluid flow directed from the variable stage compressor toward the second heat exchanger to be directed through the bypass passage from a location immediately upstream of the second heat exchanger to a location downstream of the second heat exchanger and upstream of the first heat exchanger to bypass all heat exchangers between the variable stage compressor and the first heat exchanger, including bypass of the second and third heat exchangers, to reduce a thermal exchange between the fluid flow and the second air flow directed through the second heat exchanger; and a controller configured to control the variable stage compressor and the valve arrangement for each stage of operation of the variable stage compressor such that the variable stage compressor operates in a lowest respective stage associated with satisfying a demand of the first air flow, wherein, when a demand is less than a capacity of the heat pump system to exchange thermal energy with an air flow and the variable stage compressor is at a minimum capacity, the controller controls the valve arrangement to incrementally open and close the bypass passage to satisfy the demand, until a minimum opening or maximum opening of the valve arrangement is reached, and wherein, when the demand is greater than the capacity of the heat pump system to exchange thermal energy with the air stream and the valve arrangement is at the minimum opening, the controller controls the valve arrangement to maintain the bypass passage and controls the variable stage compressor to increase a capacity of the variable stage compressor to satisfy the demand, until a maximum capacity of the variable stage compressor is reached.

12. The heat pump system of claim 11 wherein the first heat exchanger is further defined as an evaporator and the second heat exchanger is further defined as a condenser.

13. The heat pump system of claim 11 wherein the third heat exchanger is further defined as a coaxial fluid heat exchanger and further comprising another bypass passage disposed between an inlet associate with the variable stage compressor and an outlet associated with the coaxial fluid heat exchanger that is upstream of the first heat exchanger and the variable stage compressor.

14. The heat pump system of claim 13 further comprising a further bypass passage that extends between an upstream side of the second heat exchanger and an upstream side of the coaxial fluid heat exchanger.

15. The heat pump system of claim 14 wherein the further bypass is further defined as a first portion and a second portion and wherein the second portion includes an outlet passage connected to an inlet associated with the first heat exchanger.

* * * * *